US006179218B1

(12) United States Patent
Gates

(10) Patent No.: US 6,179,218 B1
(45) Date of Patent: Jan. 30, 2001

(54) SOLAR POWERED WATER FOUNTAIN

(76) Inventor: Christopher Gates, 1325 Rte. 173, Chittenango, NY (US) 13037

( * ) Notice: Under 35 U.S.C. 154(b), the term of this patent shall be extended for 0 days.

(21) Appl. No.: 09/242,287

(22) PCT Filed: Aug. 29, 1997

(86) PCT No.: PCT/US97/15360

§ 371 Date: Feb. 2, 1999

§ 102(e) Date: Feb. 2, 1999

(87) PCT Pub. No.: WO98/08617

PCT Pub. Date: Mar. 5, 1998

Related U.S. Application Data

(60) Provisional application No. 60/024,871, filed on Aug. 30, 1996.

(51) Int. Cl.[7] ..... B05B 17/08

(52) U.S. Cl. ..... 239/17; 239/23; 239/211; 417/423.3

(58) Field of Search ..... 239/17, 20, 22, 239/23, 211, 289; 417/411, 423.1, 423.3

(56) References Cited

U.S. PATENT DOCUMENTS

| | | | | |
|---|---|---|---|---|
| 783,612 | | 2/1905 | Levy . | |
| 2,533,936 | | 12/1950 | Holmes et al. . | |
| 2,968,120 | * | 1/1961 | Reed | 239/17 X |
| 4,744,335 | | 5/1988 | McAnally . | |
| 4,906,359 | * | 3/1990 | Cox, Jr. | 210/170 |
| 5,040,726 | | 8/1991 | Dimitri . | |

* cited by examiner

*Primary Examiner*—Andres Kashinikow
*Assistant Examiner*—Robin O. Evans
(74) *Attorney, Agent, or Firm*—Phillip E. Decker

(57) ABSTRACT

A solar powered water fountain comprising at least one solar cell (10) electrically connected to a direct current motor (12), which is connected by a shaft to a submersible, seal-less pump having at least one output orifice. The fountain may be stationary, or mounted on a float (18); It may be in the shape of a lily pad, or any other shape. The apparatus may include a decorative motor cowling (32), for example, in the shape of a frog.

23 Claims, 5 Drawing Sheets

SOLAR POWERED WATER FOUNTAIN

This application claims the benefit of U.S. Provisional Application Ser. No. 60/024,871, filed Aug. 30, 1996.

BACKGROUND

1. Field of the Invention

The invention relates to apparatuses for creating a fountain of water in a bird bath, pond, or pool, or for towing a fishing lure, by solar power.

2. Description of the Related Art

Bird baths, backyard ponds, and pools, are highly-valued features of residential yards and gardens. As the pace of life continues to quicken, features such as these that draw one's attention to aesthetic pleasures and to nature become increasingly important to a person's well-being. A fountain placed in a bird bath, pond, or pool, may help to draw one's attention to that feature in an aesthetically pleasing manner. However, a suitable fountain that is also easily affordable has not been found in the prior art.

A water fountain that is powered by an external electricity source, for example, requires wire installation that could involve burying wires in a lawn. Installation could also involve making water tight electrical seals and connections within the fountain. This creates the hazard of electrocution. A fountain powered by an external water source is connected to a garden hose, if not to hard line plumbing, which takes effort and know-how to install. And a fountain powered by batteries would need frequent battery replacement.

There is a need, therefore, for a fountain that will operate just as it comes out of the manufacturer's box without wiring or plumbing, is aesthetically pleasing, inexpensive, not wasteful of resources, and shoots an impressive plume of water into the air. Such a fountain is found in the present invention, a self-contained, solar-powered water fountain.

Many challenges exist for a solar-powered water fountain, to successfully apply the disparate arts of solar electricity and apparatuses useful as bird bath fountains. The solutions meeting these challenges are also a part of the present invention.

For example, a solar-powered electric motor would have to operate in a wet environment, which is well-known in the art to be detrimental to the life of the motor. Another problem is that solar cells are inherently unsightly. A third problem is that it is difficult for an electric motor to start-up under low voltage conditions, such as those conditions found in low sunlight. Fourth, a hydraulic pump having seals and other close-fitting parts creates a substantial ambient load on the pump motor. Fifth, solar cells are the most expensive components, and the cost of the apparatus will be almost directly proportional to the cost of the solar cells. Lastly, the overall efficiency of the machine must create an impressive plume of water, capable of satisfying the expectations of the purchaser.

For the foregoing reasons, there is a need for a solar-powered water fountain that can operate in a wet environment, minimizes the view of solar cells, starts in low-voltage conditions, has a pump having low ambient load on the system, minimizes the cost of solar cells, and creates an aesthetically pleasing plume of water. The same technology may be used to power an underwater jet instead of a plume of water into the air for the purpose of towing a fishing lure.

SUMMARY

The present invention is directed to an apparatus that satisfies these needs. A solar-powered water fountain having the features of the present invention comprises at least one solar cell electrically connected to a direct current motor, which is connected by a shaft to a submersible, seal-less pump having at least one output orifice, all mounted on an aesthetically-pleasing float. On embodiment may comprise an output orifice that is underwater, thereby propelling the float and facilitating the towing of an object, for example, like a fishing lure.

These and other features, aspects, and advantages of the present invention will become better understood with regard to the following description and accompanying drawings.

DRAWINGS

DESCRIPTION

Figure 6:
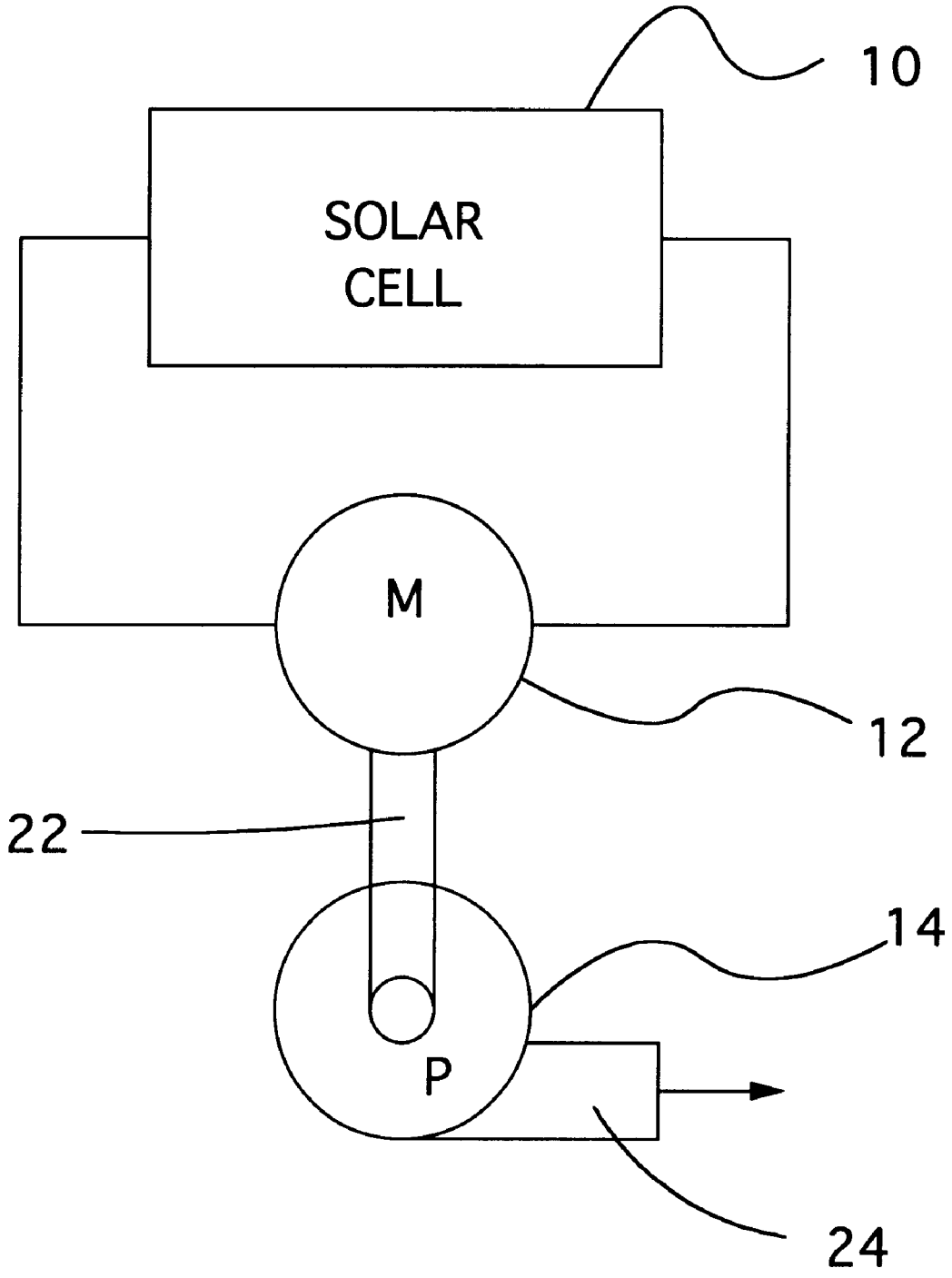
FIG. 6 is a schematic diagram of some of the important parts of the invention.

Turning to the schematic diagram in FIG. 6, energy from sunlight is collected by at least one solar cell 10 and converted into electricity. The solar cell is electrically connected by wires, for example, to an inexpensive direct current (DC) motor 12. The motor 12 turns a shaft 22, which mechanically drives a pump 14. The pump 14 has an outlet 24 from which water is driven.

Figure 2:
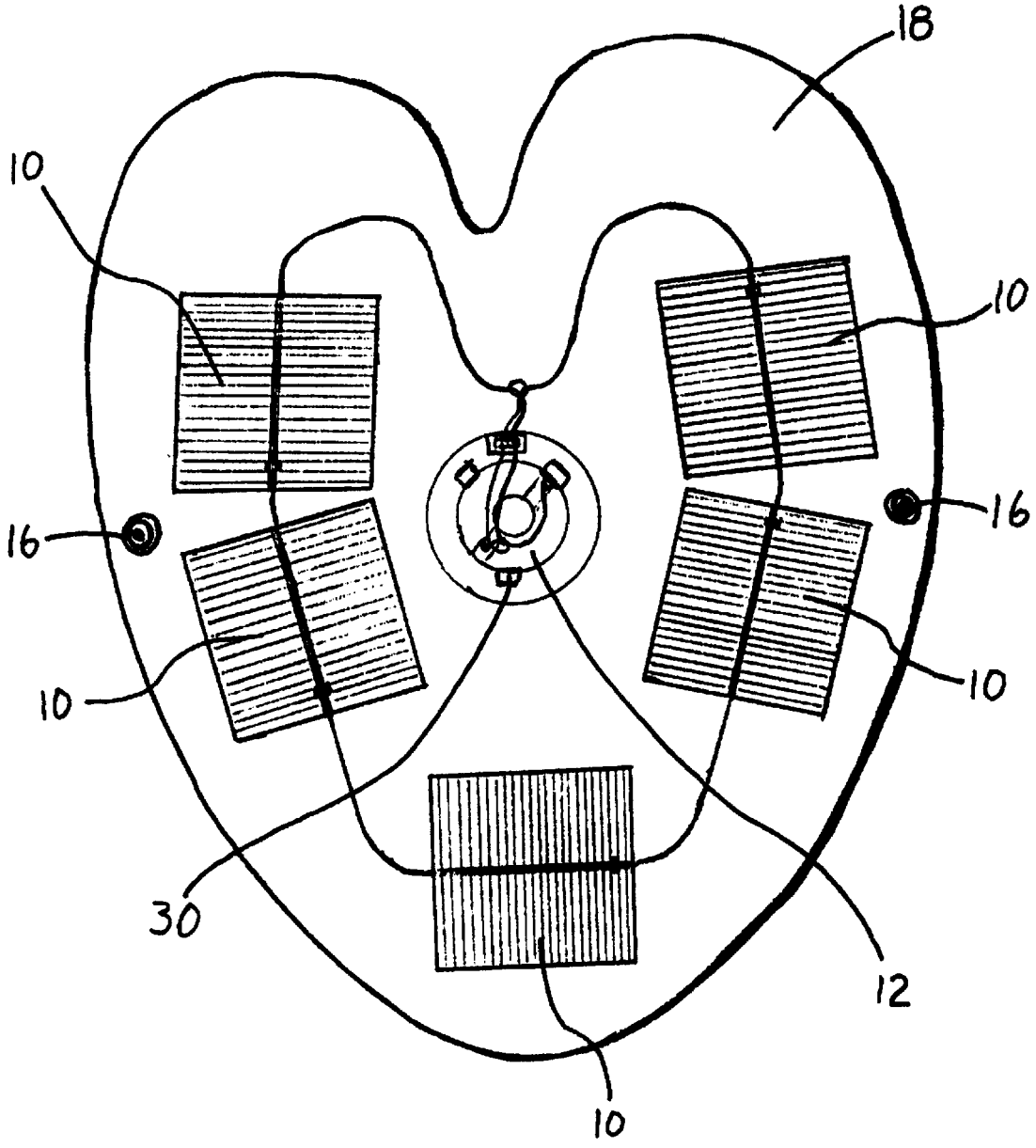
FIG. 2 is a top plan view.
Figure 3:
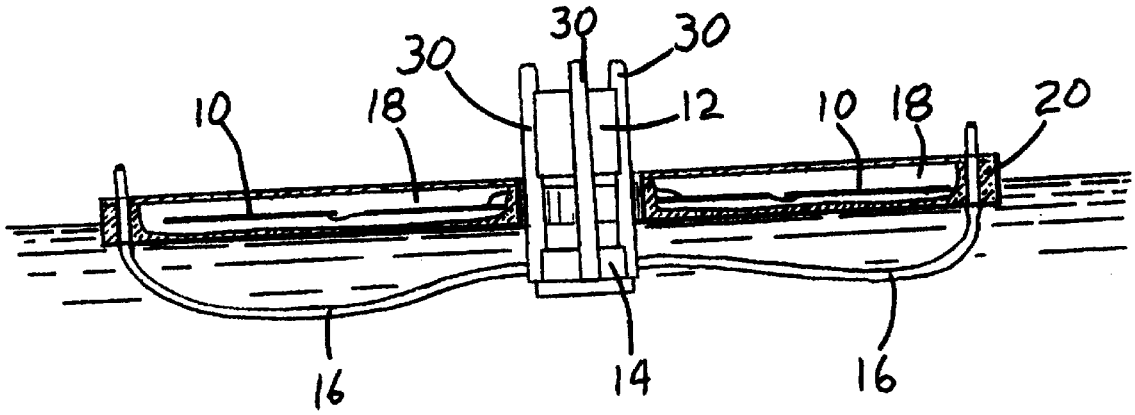
FIG. 3 is a side elevation.
Figure 4:
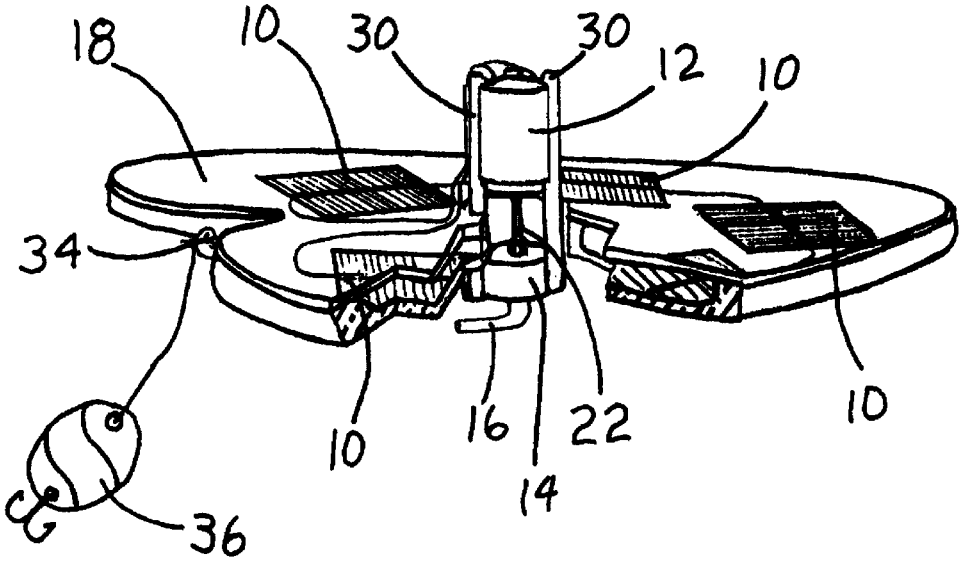
FIG. 4 is a cut-away perspective view showing an embodiment as a fishing lure tow.

In the embodiment shown in FIGS. 2, 3, and 4, the components are arranged such that the solar cells 10 and wires are electrically connected in series and cast into the material of the float 18. The solar cells in this embodiment are 4×4 cm solar cells, although other commercially-available solar cells may be used. The surface area of the solar cells should be between about eight and fifty square centimeters. The preferred embodiment uses five solar cells. When five are used, the apparatus is capable of producing two impressive 0.06 inch (0.16 cm) diameter plumes of water approximately ten inches (25 m) into the air.

The two wire leads exit the float material near a center portion where the motor 12 is secured. As more clearly shown in FIG. 3, the motor 12 is secured by securing means in a substantially vertical and aligned position over the pump 14, which is submerged. The securing means may include the use of brackets or supports 30, together with glue, epoxy, screws, bolts, or other means well-known to those skilled in the art.

The motor 12 and pump 14 are secured in this position on a float 18. In one embodiment, the motor 12 is a RADIO SHACK 1.5–3.0 volt DC motor, part number 273-223, although other commercially-available motors may be used. Motors between 0.5 and 12 volts may also operate well in this application.

The float 18 is shown in the shape of a lily pad, but can be formed into any aesthetically pleasing shape. The float 18 is preferably made out of epoxy resin, acrylic, or other clear or translucent material that is capable of floating its own weight in addition to the weight of the other components. In the embodiment shown, the substantially rigid float is clear, about 0.5 inches (1.3 cm) in thickness, and has an average diameter of about 7 inches (18 cm). In other embodiments, the motor 12 and pump 14 may be secured to an object that does not float, but merely rests on the bottom or on a support underneath the object. The material would have to be more dense than water.

On a bottom portion of the float 18 is a colored layer or substrate 20. In the preferred embodiment, the color green is applied as spray paint directly to the bottom of the float 18. When arranged in this manner, the entire volume of the float 18 appears to have the color of the colored layer when the apparatus is viewed at an angle, due to the angle of refraction through the material. This effectively masks the unsightliness of the solar cells 10, while at the same time letting a maximum amount of light reach them, and is a surprising and unexpected result.

Figure 1:
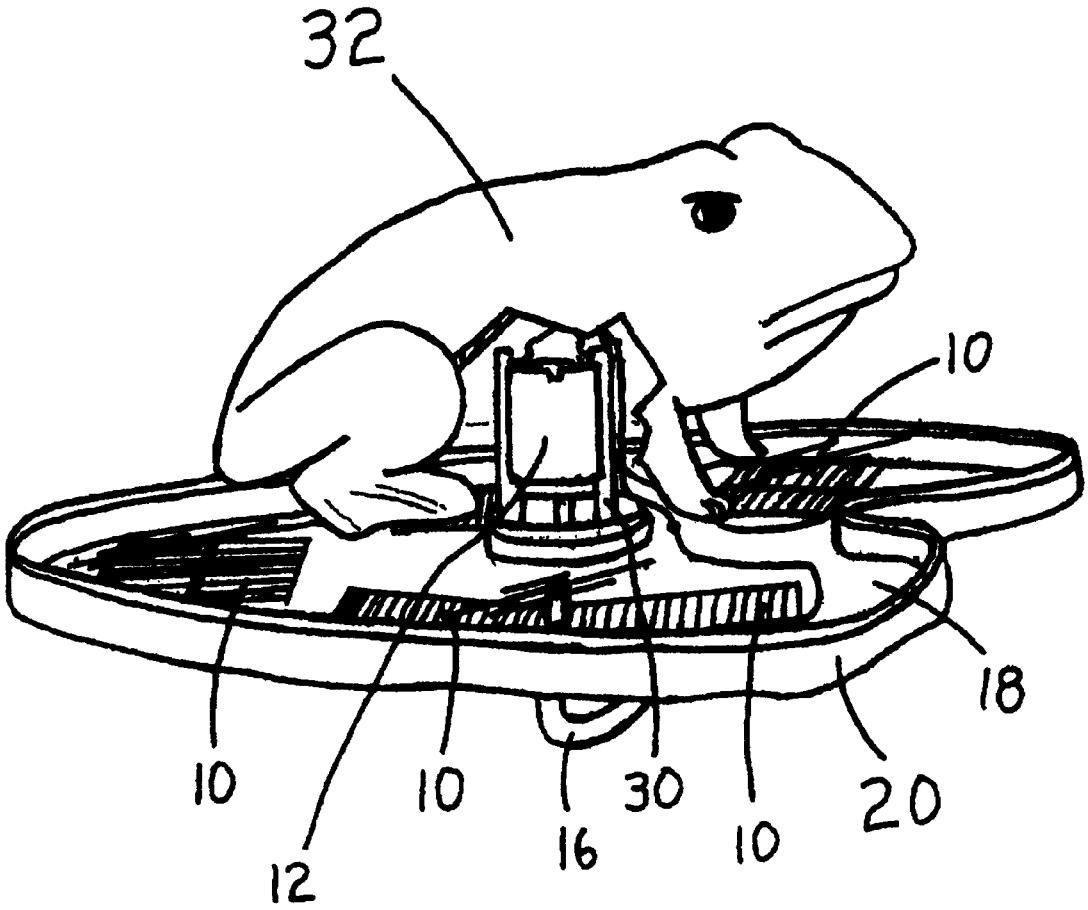
FIG. 1 is a perspective view of one embodiment of the invention.
Figure 5:
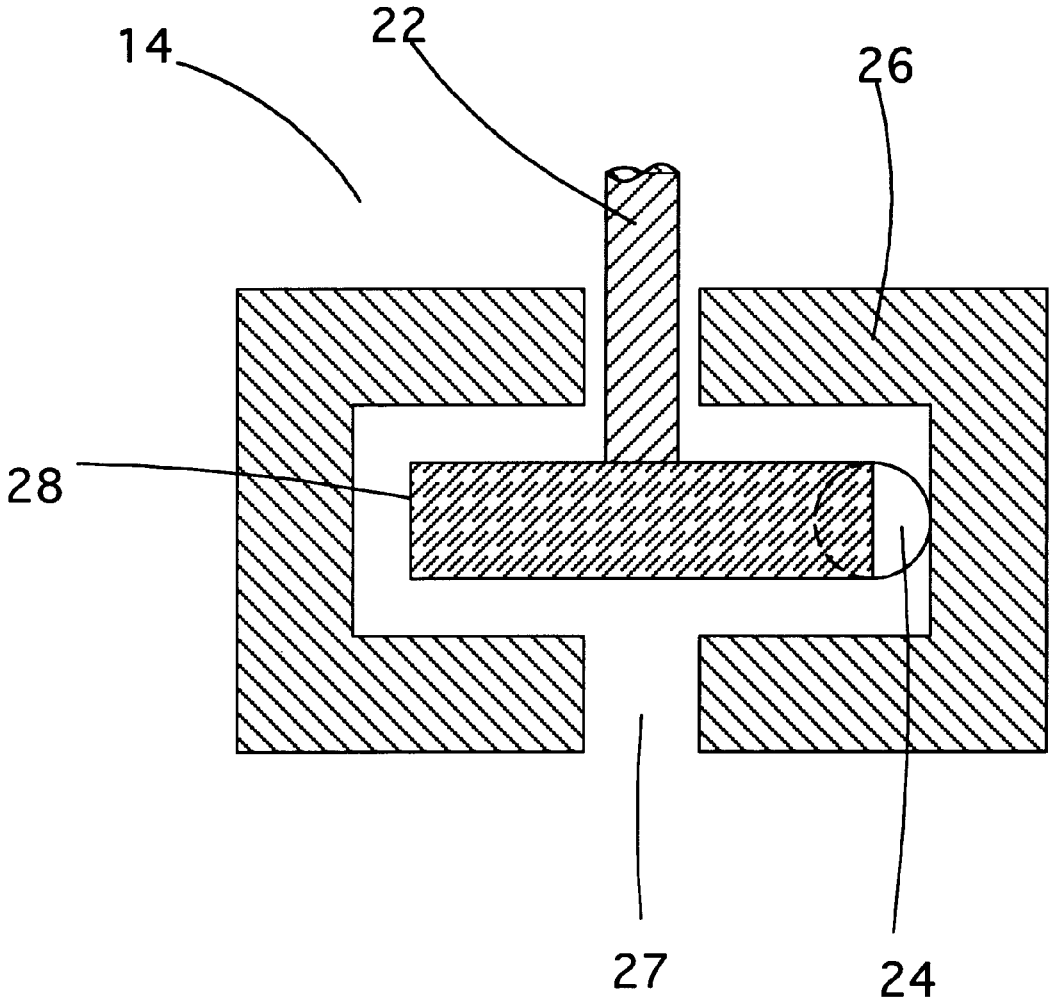
FIG. 5 is cut-away detail of the submersible, seal-less pump assembly.

At least one water discharge tube 16 is run from the pump 14, underneath the float 18, and up to the surface outlet. FIGS. 5 and 6 more clearly show that the tube 16 runs from the pump discharge outlet 24. The number of tubes 16 to use depends on the power available from the solar cells used, and the preference of the manufacturer. The tubes are preferably ultraviolet resistant material, having preferably a 0.25 inch (0.6 cm) outside diameter, such as that used in aquariums. The apparatus can have one pump discharge outlet 24, as shown in FIG. 1, can have two as shown in FIG. 2, or can have one discharge outlet leading to a tee or a manifold and having two tubes connected thereto, as in the preferred embodiment.

The pump 14, shown in detail in FIG. 5, comprises a pump casing 26, an inlet 27, a discharge outlet 24, and an impeller 28, which is connected to a motor shaft 22. These components can be manufactured from any substantially rigid material, but the shaft 22 is metal and the rest is made of plastic.

The casing preferably is about 0.5 inches (1.3 cm) in outside height and has an outside diameter of about 1 inch (2.5 cm). The inlet 27 has a diameter of about 0.25 inches (0.6 cm), which is substantially the same diameter as the shaft hole for ease of manufacture and for providing a very loose fit to the shaft 22. The pump cavity inside the casing 26 is substantially centrally located inside the casing, is about 0.25 inches (0.6 cm) in height, and has an about 0.6 inch (1.5 cm) diameter.

The impeller 28 is a substantially rectangularly-shaped bar of material that is about 0.5 inches (1.3 cm) in length and about 0.2 inches (0.5 cm) in height as shown in FIG. 3. The thickness of the impeller is about 0.06 inches (0.15 cm). The discharge outlet 24, which is set tangentially to the diameter of the pump cavity, is between about 0.4 inches (0.1 cm) and about 0.2 inches (0.5 cm) in diameter. The pump shaft 22 diameter is about 0.1 inches (0.25 cm).

These are the dimensions of the preferred embodiment, and pumps of other dimensions may be used. The advantages of these dimensions is that the loose fitting surfaces between the shaft 22 and the housing, in addition to the absence of seals, provide almost no resistance to the operation of the motor 12. The size of the impeller 28 also provides clearance from the pump cavity, so that during start up the impeller can start turning while impelling only a small quantity of water. This greatly aids start up of the motor. When the motor reaches operating speed, the amount of water impelled is substantial and sufficient to produce an impressive plume of water. A pump such as the one described is also inexpensive to produce, and is not found in the prior art. That this inexpensive pump achieves the results of producing impressive plumes of water, while being capable of starting in low-power conditions is also a surprising and unexpected result.

The embodiment in FIG. 4 shows the optional tow hook 34 secured on one side of the float 18. The discharge tube 16 is not secured to the top of the float as in other embodiments, but it directed in a horizontal position such that it propels the apparatus in one direction when under power by sunlight. A fishing lure 36 can be attached to the tow hook 34 by fishing line. The result is a version of the present invention that is an effective fishing novelty which is useful for fishing as well as an aesthetically-pleasing water craft.

Another embodiment, not shown, is a self-propelled version with the discharge tube 16 directed in a horizontal position, like that in FIG. 4 with the float colored and shaped as a water bug, turtle, snake, alligator, crocodile, or other creature or object likely to be found in an aqueous environment. The tow hook 34 would not be necessary in those embodiments.

FIG. 1 shows another embodiment of the present invention having a motor cover in the shape of a frog. While this particular embodiment is very aesthetically pleasing, a covering of any shape will aid in keeping the motor dry. However, its use is not a limitation to this invention.

One of the several problems which exist in joining the two disparate arts of solar energy and water fountains is that of operating an electric motor 12 in an environment of wetness. The solution employed in the present invention is the use of a DC motor. A DC motor such as that described can operate when completely soaked, or even under water. Although more electricity escapes into the water the wetter the motor becomes, the motor continues to operate with no apparent ill effects.

Another problem is that solar cells 10 are inherently unsightly. This problem is solved by embedding the cells within the structure of the float 18, and tinting the bottom substrate 20. The float 18 material can remain clear. The result is that the substrate 20 colors the whole float due to the incidence of refraction of the float. This way the solar cells 10 are barely noticeable. This solution is a surprising and unexpected result.

The third problem is the difficulty of starting a DC motor 12 under low-light, low-voltage conditions. Starting a motor with low voltage, especially with a load on the shaft 22, accelerates wear on the motor. The temperature of the motor tends to increase, shortening its life. A motor can even burn up under low voltage conditions. The problem is solved in the present invention by using very loose fits between the impeller 28, and casing 26, which allows water to slip around the impeller 28 inside the pump casing 26, so that the motor can start up with almost no load upon it whatsoever.

The fourth problem is the resistance caused by commercially-available pumps of this size and volume. Resistance caused by pump seals and internal parts would place a significant ambient load upon the pump motor. The solution presented in this invention is the use of a pump with no seals and loose fits. This employs the principle that load on a pump 12 is proportional to the speed of the impeller 28. High speed results in high resistance, but low speed provided low resistance.

The fifth problem is the high cost of solar cells 10 relative to the other components of the apparatus. It is an object of the invention to provide and inexpensive apparatus, and this objective is met by minimizing the number of solar cells required by connecting them directly to the motor 12. There is no energy loss due to extraneous elements like rechargeable batteries or controls. By minimizing the number of electrical devices, almost all of the energy goes into the motor and very little is lost.

The last problem is the combination of the various elements into a fountain that is efficient, aesthetically pleasing, inexpensive, not wasteful of resources, and shoots an impressive plume of water into the air. The present invention solves the problem by providing a solar-powered water fountain comprising at least one solar cell electrically connected to a direct current motor, which is connected by a shaft to a submersible, seal-less pump having at least one output orifice, all mounted on an aesthetically-pleasing float.

While there have been described what are presently considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

I claim:

1. A solar-powered water fountain comprising at least one solar cell electrically connected to a DC motor having a shaft connected to a submersible, seal-less pump hydraulically connected to at least one output orifice, said solar cell, motor, and pump mounted on a float, such that light striking the solar cell creates electricity that drives the motor which impels water through the pump to the output orifice and thereby emits a plume of water into the air.

2. The fountain of claim 1 wherein said float is made of a substantially clear material that floats in water and at least one solar cell is disposed within the float material.

3. The fountain of claim 2 wherein the float material is taken from the group consisting of epoxy resin and acrylic.

4. The fountain of claim 2 wherein said float has a bottom side that is in contact with water when floating, and having a colored layer applied to said bottom side.

5. The fountain of claim 2 wherein a plurality of said solar cells are electrically connected in series to the motor.

6. The fountain of claim 2 wherein said solar cells are about 4 cm by about 4 cm in size.

7. The fountain of claim 5 comprising five solar cells.

8. The fountain of claim 1 wherein said motor has an axis about which the shaft rotates, and wherein said motor is secured to the float above the water such that the axis is perpendicular to the water surface when floating.

9. The fountain of claim 1 wherein said motor is rated between about 0.5 volts and about 12 volts.

10. The fountain of claim 1 wherein said float has a bottom side that is in contact with water when floating, said seal-less pump is secured to the bottom side of the float, and said motor and shaft are axially aligned with the pump.

11. The fountain of claim 1, said pump comprising a substantially cylindrical casing, an inlet, a shaft hole, at least one discharge outlet, and an impeller.

12. The fountain of claim 11, wherein said shaft hole and inlet are about 0.6 cm in diameter.

13. The fountain of claim 11, wherein said casing has an inside diameter of about 1.5 cm, and an inside height of about 0.6 cm.

14. The fountain of claim 11, wherein said impeller is a substantially rectangular-shaped bar of material about 1.3 cm in length, 0.5 cm in height, and 0.15 cm in thickness.

15. The fountain of claim 11, wherein said discharge outlet is between about 0.1 cm and about 0.5 cm in diameter.

16. The fountain of claim 11, wherein at least one output orifice is disposed within said float, said fountain further comprising at least one discharge tube having a first and second end, said first end hydraulically secured to the pump discharge outlet, and said second end hydraulically secured to said output orifice.

17. The fountain of claim 16, further comprising a manifold having one manifold inlet and at least one manifold outlet, said manifold inlet hydraulically secured to a discharge outlet, and each manifold outlet hydraulically secured to a discharge tube first end.

18. The fountain of claim 16, wherein said discharge tube is made from an ultra-violet resistant material.

19. The fountain of claim 1, wherein said float is made of a substantially clear material that is more dense than water and at least one solar cell is disposed within the float material.

20. The fountain of claim 11, further comprising a discharge tube having a first end and a second end, said first end hydraulically secured to the pump discharge outlet and said second directed to a direction substantially parallel to the water surface such that in operation the float is propelled in the opposite direction.

21. The fountain of claim 20, further comprising a tow hook secured to said float for securing a fishing lure to the float.

22. The fountain of claim 1, further comprising a motor cover covering the motor.

23. The fountain of claim 1, wherein the area covered by solar cells is between about 8 and 50 square cm.

* * * * *